US009691367B2

(12) United States Patent
Shigenaga

(10) Patent No.: US 9,691,367 B2
(45) Date of Patent: Jun. 27, 2017

(54) DRUM FOOT PEDAL APPARATUS

(71) Applicant: YAMAHA CORPORATION, Hamamatsu-shi (JP)

(72) Inventor: Fumihiro Shigenaga, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/278,704

(22) Filed: Sep. 28, 2016

(65) Prior Publication Data

US 2017/0092241 A1 Mar. 30, 2017

(30) Foreign Application Priority Data

Sep. 30, 2015 (JP) ..... 2015-194503

(51) Int. Cl.
*G10D 3/02* (2006.01)
*G10D 13/00* (2006.01)

(52) U.S. Cl.
CPC ..... *G10D 13/006* (2013.01)

(58) Field of Classification Search
CPC ..... G10D 13/006
USPC ..... 84/422.1
See application file for complete search history.

(56) References Cited

U.S. PATENT DOCUMENTS 1,343,164 A 6/1920 Smith
4,200,025 A 4/1980 Currier
4,691,612 A 9/1987 Smith
5,565,637 A * 10/1996 Shigenaga ..... G10D 13/006 84/422.1
5,798,472 A 8/1998 Shigenaga
5,817,962 A 10/1998 Behrenfeld
5,932,824 A 8/1999 Liao
5,936,177 A 8/1999 Shigenaga
5,945,616 A * 8/1999 Hoshino ..... G10D 13/065 84/422.3

(Continued)

FOREIGN PATENT DOCUMENTS

JP H0895557 A 4/1996
JP 2806301 B2 9/1998

OTHER PUBLICATIONS

Office Action issued in U.S. Appl. No. 15/278,781 mailed Jan. 18, 2017.
Copending U.S. Appl. No. 15/278,781, filed Sep. 28, 2016.

*Primary Examiner* — Jianchun Qin
(74) *Attorney, Agent, or Firm* — Rossi, Kimms & McDowell LLP

(57) ABSTRACT

A drum foot pedal apparatus is provided which can effectively prevent, by a spike member, positional displacement of the apparatus from occurring due to depression of a foot board and permits adjustment of a projected amount of the spike member with a simple construction. The apparatus includes: a base member fixed at one end to a frame section and fixed at the other end to a heel member, thereby interconnecting the frame section and the heel member; and a spike member provided on the base member in such a manner as to be projectable downward beyond the lower surface of the base member. The spike member is disposed at a position where it does not positionally overlap the foot board, and the spike member is constructed so that the projected amount of the spike member is adjustable by an operation from above the upper surface of the foot board.

3 Claims, 8 Drawing Sheets

(56) References Cited

U.S. PATENT DOCUMENTS

| | | | |
|---|---|---|---|
| 5,998,719 | A | 12/1999 | Chuang |
| 6,028,259 | A | 2/2000 | Lombardi et al. |
| 7,122,730 | B2 | 10/2006 | Takegawa |
| 7,626,108 | B1 | 12/2009 | Takegawa |
| 8,633,367 | B2 | 1/2014 | Steinhauser et al. |
| 8,859,871 | B2 | 10/2014 | Liao |

* cited by examiner

DRUM FOOT PEDAL APPARATUS

BACKGROUND

The present invention relates generally to drum foot pedal apparatus which generate a tone by pivoting a beater, in response to depression of a foot board, to thereby strike a drum head or bass drum pad (kick pad) with the beater.

Drum foot pedal apparatus have been known which generate a tone by pivoting a beater, in response to depression of a foot board (foot pedal), to thereby strike a drum head with the head of the beater. The conventionally-known drum foot pedal apparatus, as shown for example in Japanese Patent No. 2806301 (hereinafter referred to as "Patent Literature 1"), include a pivot shaft having the beater mounted thereon, a pair of left and right struts pivotably supporting the pivot shaft, and a transmission member, such as a chain, interconnecting the distal end of the foot board and the pivot shaft. According to the disclosure of Patent Literature 1, a spring (extension or tension coil spring) for normally urging or biasing the foot board toward an initial (non-depressed) position of the foot board is connected to either or both of the opposite ends of the pivot shaft. The spring is engaged at its upper end by a roller, via a link member, that is in turn rotatably supported on a crank arm, and also the spring is engaged at its lower end in a through-hole of an adjusting screw provided for adjusting the tension of the spring.

With such conventionally-known drum foot pedal apparatus, however, repeated depressing operations of the foot board may undesirably cause positional displacement of the drum foot pedal apparatus relative to a floor surface (installing surface) of an installation site. Thus, to prevent such positional displacement of the drum foot pedal apparatus, spike members are attached to or provided on a frame (front frame) section having the left and right strut members. As shown for example in Japanese Patent Application Laid-open Publication NO. HEI-8-95557 (Patent Literature 2), each of the spike members is, for example, in the form of a screw having a gradually tapered and sharpened distal end portion that is projectable downward beyond the lower surface of the frame section. Namely, as the spike members are projected downward beyond the lower surface of the frame section when the foot pedal apparatus is to be installed on an installation site, the distal end portions of the spike members bite into a carpet or the like laid on the floor surface (installing surface) of the installation site to thereby prevent positional displacement of the drum foot pedal apparatus relative to the installing surface. Another example construction of the spike member has also been known in which the spike member provided on a side surface of a heel section of the foot pedal apparatus is pivotable between a retracted position and a projected position.

However, the conventionally-known drum foot pedal apparatus having the spike members as shown in Patent Literature 2 would present the problem that the spike members cannot provide a sufficient lateral-rotational-displacement preventing force, i.e. force for retaining the foot pedal apparatus on the installing surface against lateral rotational force (i.e., clockwise and counterclockwise, or rightward and leftward, rotational force acting within a plane parallel to the installing surface) produced by depression of the foot board. Particularly, with a foot pedal apparatus of a double-pedal structure including a pair of left and right foot pedals (foot boards), the left foot pedal cannot be retained appropriately enough, because the left foot pedal is supported by being connected to the right foot pedal. The spike member mounted to the side surface of the heel section too cannot appropriately achieve an effect of preventing rotational (clockwise and counterclockwise) positional displacement of the foot pedal apparatus.

Furthermore, with the foot pedal apparatus where the spike member provided on the side surface of the heel section is constructed to be pivotable between the retracted position and the projected position, it is extremely difficult to perform an operation for adjusting a projected amount of the spike member before and during a performance of the drum because operations for projecting and retracting the spike member require a tool and cannot be performed easily from above the upper surface of the foot pedal (foot board).

SUMMARY OF THE INVENTION

In view of the foregoing prior art problems, it is an object of the present invention to provide a drum foot pedal apparatus which allows a projected amount of a spike member to be adjusted with a simple construction and yet can effectively prevent positional displacement of the apparatus from occurring due to a depressing operation of a foot board.

In order to accomplish the above-mentioned object, the present invention provides an improved drum foot pedal apparatus, which comprises: a heel member; a foot board pivotably supported at one end portion by the heel member; a beater configured to strike a drum head in response to a depressing operation of the foot board; a frame section having a strut member pivotably supporting the beater; a base member fixed at one end to the frame section and fixed at the other end to the heel member, thereby interconnecting the frame section and the heel member; and a spike member provided on the heel member or the base member in such a manner that the spike member is projectable downward beyond the lower surface of the heel member or the base member, the spike member being disposed at a position where the spike member does not positionally overlap the foot board, the spike member being constructed so that a projected amount of the spike member is adjustable by an operation from above the upper surface of the foot board.

With the spike member provided on the base member and capable of being projected downward beyond the lower surface of the heel member or the base member as above, the foot pedal apparatus can be easily and effectively prevented from being positionally displaced relative to an installing surface due to a depressing operation of the foot board during a drum performance. Particularly, because the spike member is provided on the heel member or the base member rather than on the frame section, the spike member can effectively achieve the effect of retaining the foot pedal apparatus on the installing surface against lateral rotational force produced due to a depressing operation of the foot board.

Further, because the spike member is disposed at a position where the spike member does not positionally overlap the foot board and the spike member is constructed so that its projected amount is adjustable by an operation from above the upper surface of the foot board, a human player of the drum can easily adjust the projected amount of the spike member not only before but also during a drum performance. As a consequence, the human player can easily and reliably perform operations for preventing positional displacement of the foot pedal apparatus not only before but also during a drum performance.

In one embodiment of the invention, the spike member is provided on the base member, and the foot board has such a narrowed portion as to avoid contact with the spike member as viewed from above the upper surface of the foot board. With such arrangements, the human player of the drum can easily adjust the projected amount of the spike member not only before but also during a drum performance. What is more, it is possible to reliably prevent the foot board, descending in response to a human player's depressing operation, from contacting or interfering with the spike member and hence significantly enhance the operability of the foot pedal apparatus.

Further, in one embodiment, the spike member is provided on the heel member, and the drum foot pedal apparatus of the invention further comprises a cover member that detachably covers the heel member, and the spike member is disposed underneath the cover member. In a normal usage state of the foot pedal apparatus of the invention, e.g. during a drum performance, the spike member is kept retracted or stored underneath the cover member, and thus, the spike member would not become an obstacle during a performance, etc. Further, when the foot pedal apparatus of the invention is to be fixed on an installing surface by projecting the spike member, the spike member can be readily exposed for operation by a human operator or the like by merely detaching the cover member. In this way, it is possible to achieve both enhanced convenience during a drum performance and speedup of the installing operation of the foot pedal apparatus.

Further, in one embodiment, the cover member has an accommodating portion formed in the underside thereof for accommodating a head section of the spike member. With this arrangement, the spike member can be reliably accommodated in the underside of the cover member by merely attaching the cover member to the heel member after putting the cover member on the heel member.

The foot pedal apparatus of the present invention constructed in the aforementioned manner allows the projected amount of the spike member to be adjusted with a simple construction and yet can effectively prevent positional displacement of the apparatus from occurring due to a depressing operation of the foot board.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

First Embodiment

Figure 1:
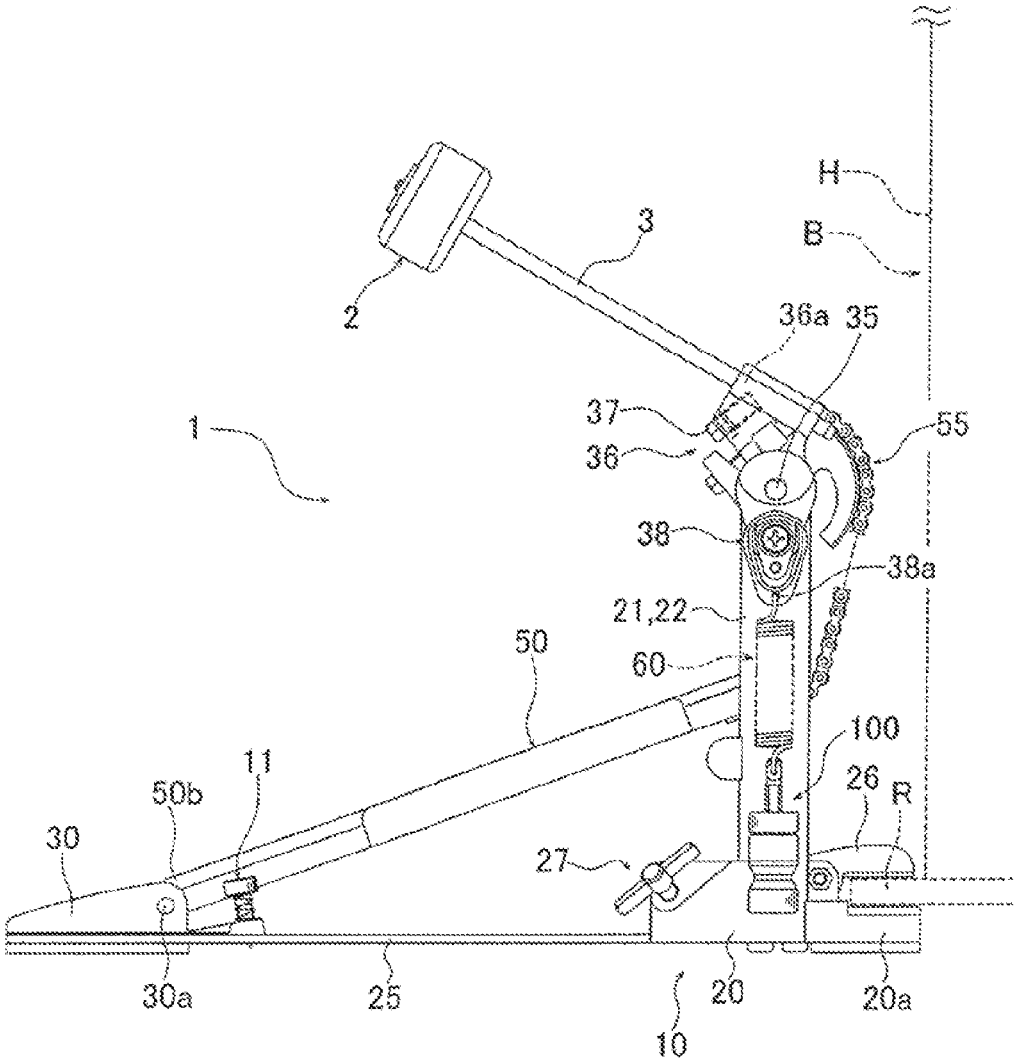
FIG. 1 is a side view showing an overall construction of a drum foot pedal apparatus according to a first embodiment of the present invention.
Figure 2:
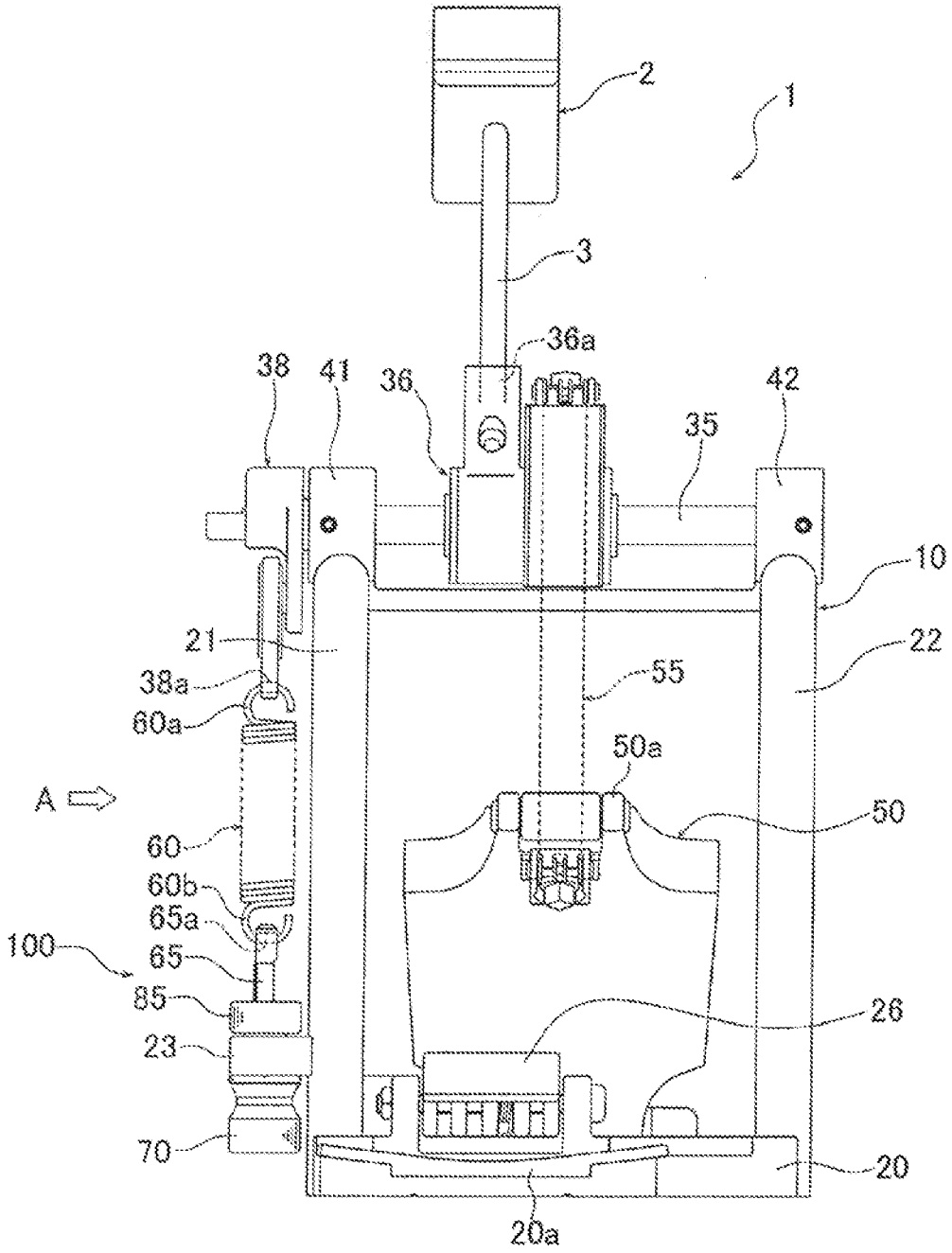
FIG. 2 is a front view of the drum foot pedal apparatus shown in FIG. 1.

FIG. 1 is a side view showing an overall construction of a drum foot pedal apparatus according to a first embodiment of the present invention, and FIG. 2 is a front view of the drum foot pedal apparatus shown in FIG. 1. The drum foot pedal apparatus 1 shown in FIGS. 1 and 2 includes a frame (front frame) section 10 placed on a floor surface (installing surface) of an installation site, and a heel member (heel section) 30 connected to a rear end portion of the frame section 10 via a base member 25. The frame section 10 includes a base section 20, a pair of left and right strut members 21 and 22 provided on and projecting upward from the upper surface of the base section 20. A clamp 26 for vertically sandwiching a hoop R of a bass drum B is mounted to the base section 20, and a hoop fixing screw 27 is provided for pressing the clamp 26 against the hoop R. By the hoop fixing screw 27 being tightened, the clamp 26 vertically sandwiches the hoop R of the bass drum B in conjunction with a front end portion 20*a* of the base section 20 to thereby fix the foot pedal apparatus 1 to the bass drum B.

A pivot shaft 35 has its opposite end portions inserted in respective upper end portions of the left and right strut members 21 and 22 in such a manner that it is pivotably supported by the left and right strut members 21 and 22. More specifically, the opposite end portions of the pivot shaft 35 are pivotably supported by bearings 41 and 42 incorporated in the upper end portions of the left and right strut members 21 and 22. A rocker 36 is mounted on an axially middle portion of the pivot shaft 35. A beater head 2 for striking a drum head H of the bass drum B is mounted to the rocker 36 via a beater rod 3, and a connection member 55 for transmitting depressing force of the foot board 50 to the beater head 2 is fixed at its upper end portion to the rocker 36. The beater rod 3 has a base or proximal end portion slidably fittingly inserted in a through-hole 36*a* formed in the rocker 36 and fixed in the through-hole 36*a* by means of a bolt 37. It is possible to change a position, in a height direction, of the drum head H at which the beater head 2 strikes the drum head H (i.e., beater-head striking height position of the drum head H), by loosening the bolt 37 and adjusting a length of a portion of the beater rod 3 projecting from the rocker 36. Although a metal chain is used as the connection member 55 in the illustrated example, a band formed of leather or synthetic resin or the like may be used as the connection member 55.

The foot board 50 is formed of a flat plate having a size large enough for a human player to place thereon his or her foot, and the foot board 50 is connected at its front end portion 50*a* to a lower end portion of the connection member 55 and connected at its rear end portion 50*b* to the heel member 30 in such a manner that it is pivotable vertically in an up-down direction about a pivot shaft 30*a*.

Further, the foot board 50 is normally urged or biased by a coil spring (foot-board biasing member) 60 in a counter-clockwise direction in FIG. 1. The coil spring 60, which is disposed along an outer side surface of one of the strut members 21, has an upper hook 60*a* engaged by a through-hole 38*a* formed in an arm member or section 38 provided on one end of the pivot shaft 35, and a lower hook 60*b* connected via a tension adjustment mechanism 100 to a mounting section 23 projecting from a near-lower-end portion of the strut member 21.

The tension adjustment mechanism 100 includes: a tension adjusting screw 65 mounted to the lower end of the coil spring 60; an adjusting nut 70 for moving the adjusting screw 65 in the up-down direction by rotation of the adjusting nut 70; and a locking nut 85 for preventing loosening of the adjusting nut 70. The adjusting screw 65 has an insertion hole 65*a* formed in an upper end portion of the adjusting screw 65, and the lower hook 60*b* of the coil spring 60 is engaged in the insertion hole 65*a*. The adjusting nut 70 is held in threaded engagement with a lower end portion of the adjusting screw 65.

Rotating the adjusting nut 70 in a tightening direction can move the adjusting screw 65 downward relative to the mounting section 23, while rotating the adjusting nut 70 in a loosening direction can move the adjusting screw 65 upward relative to the mounting section 23. Thus, the biasing force of the coil spring 60 acting on the foot board 50 can be adjusted manually by rotating the adjusting nut 70 to adjust a height position (relative to the mounting section 23) of the adjusting screw 65. Once desired adjustment is completed, the locking nut 85 is tightened to positionally fix the adjusting screw 65 and the adjusting nut 70.

As the human player depresses the foot board 50 with his or her foot in the drum foot pedal apparatus 1 constructed in the aforementioned manner, the connection member 55 is pulled downward to cause the rocker 36 to pivot, in a clockwise direction in FIG. 1, together with the pivot shaft 35, so that the beater head 2 strikes the drum head H of the bass drum B. Then, as the human player removes the depressing force from the foot board 50 after the beater head 2 has struck the drum head H of the bass drum B, the pivot shaft 35 pivots in a direction, opposite the direction it pivoted at the time of the drum striking, by the tensile force of the coil spring 60, and thus, the beater head 2 and the foot board 50 return to their respective initial positions to thereby permit a next striking operation. The beater head 2, the beater rod 3, etc. together constitute a beater for striking the drum head H in response to a human player's depressing operation of the foot board 50.

Figure 3:
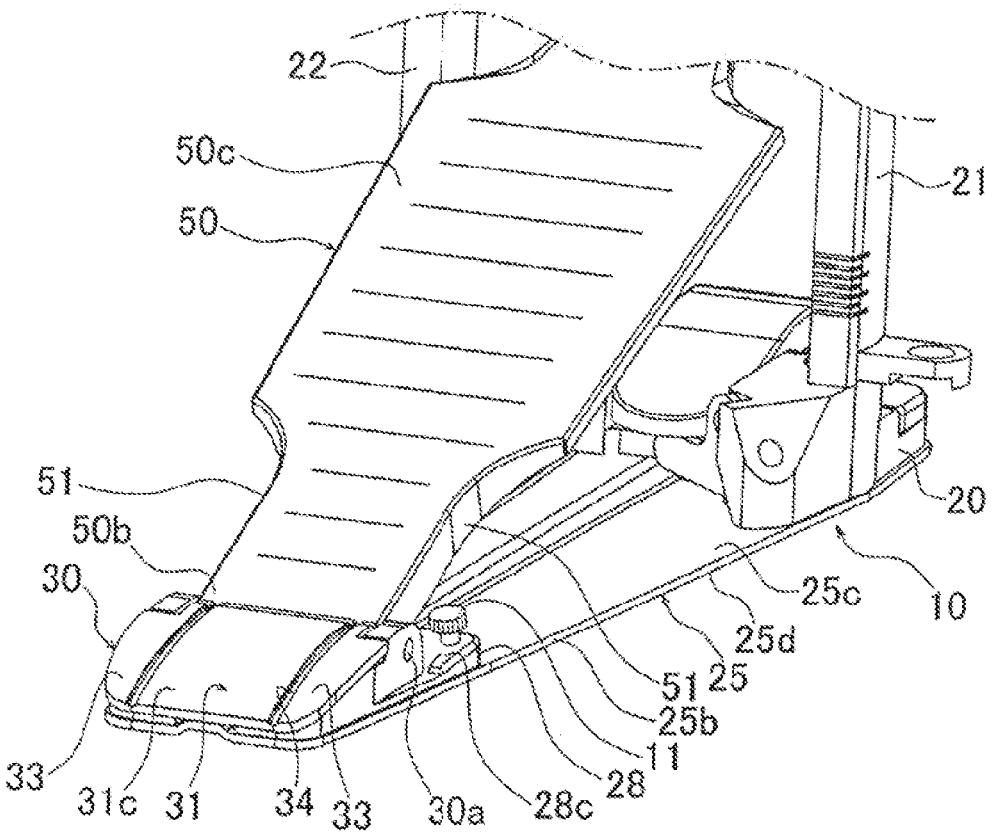
FIG. 3 is a perspective view showing a heel member and parts of a base member and a foot board in the drum foot pedal apparatus.
Figure 4:
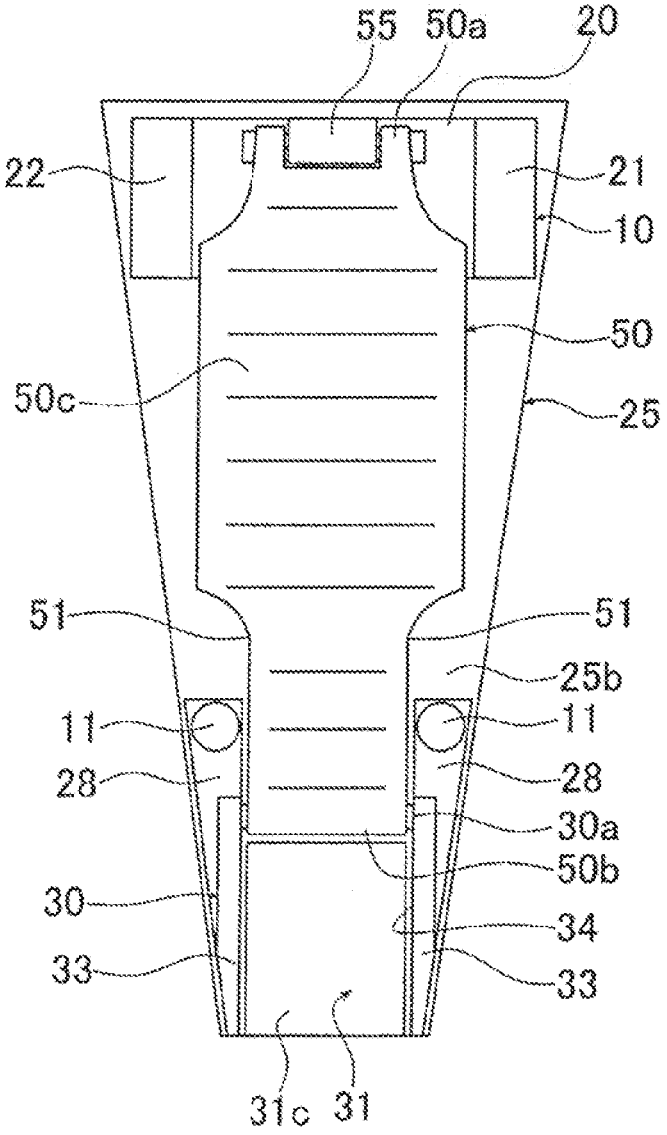
FIG. 4 is a schematic top plan view of the heel member, the base member and the foot board shown in FIG. 3.

FIG. 3 is a perspective view showing the heel member 30 and parts of the base member 25 and the foot board 50 in the drum foot pedal apparatus 1. FIG. 4 is a schematic top plan view of the heel member 30, the base member 25 and the foot board 50 shown in FIG. 3. A region between left and right wide walls 33 of the heel member 30 is a recessed portion of a generally rectangular sectional shape, and a cover member 31 is put on and detachably attached to the recessed portion 34 so as to detachably cover the heel member 30. The cover member 31, which is a one-piece element formed integrally of a suitable material such as rubber, has such a shape as to extend along and cover the recessed portion 34, the upper surface 31*c* of the cover member 31 slants downward in a front-to-rear direction of the foot pedal apparatus 1.

The first embodiment of the foot pedal apparatus 1 also includes spike members 11 provided on (attached to) a rear end portion 25*b* of the base member 25 near the heel member 30. More specifically, the spike members 11 are provided one on each of widthwise opposite side edge regions of the rear end portion 25*b* of the base member 25, and each of the spike members 11 is capable of being projected downward beyond the lower surface of the base member 25. Such spike members 11 can prevent unwanted positional displacement of the foot pedal apparatus 1 relative to the floor surface of the installation site.

Figure 5:
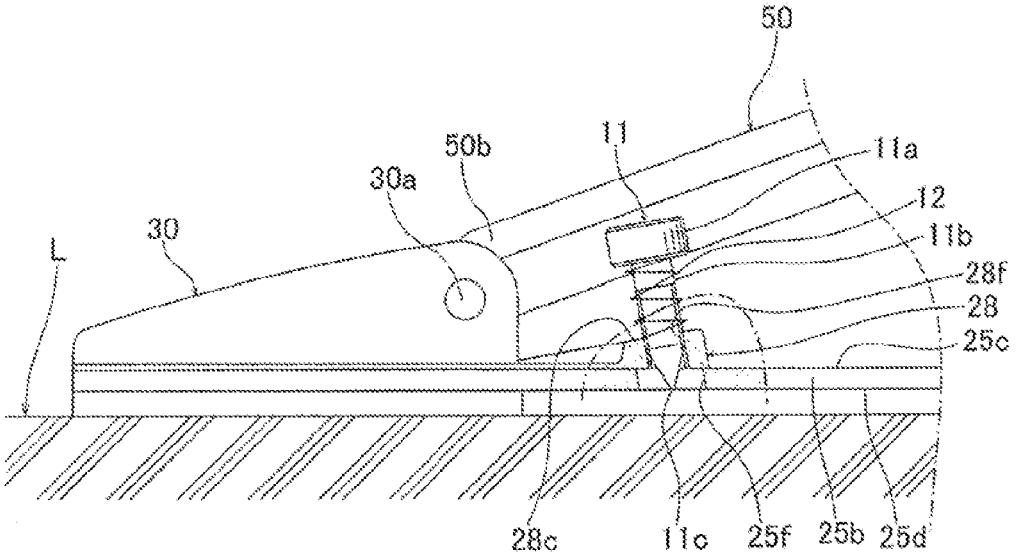
FIG. 5 is a side view, partly in section, showing details of a spike member employed in the drum foot pedal apparatus.

FIG. 5 is a side view, partly in section, showing details of each of the spike members 11. As shown in the figure, each of the spike members 11 integrally includes a head section 11*a* for being pinched or held with fingers of a human operator or player to operate the spike member 11, and a shaft section 11*b* extending downward from the head section 11*a*. The shaft section 11*b* is threaded on the outer peripheral surface thereof and has a gradually tapered and sharpened distal end portion (lower end portion) 11*c*. Left and right upwardly-projecting pedestal sections 28 are provided on widthwise opposite side edge regions of the rear end portion 25*b* of the base member's upper surface 25*c*. The upper surface 28*c* of each of the pedestal sections 28 is formed as a flat surface gradually slanting upward in a rear-to-front direction of the base member 25 so that a height position of the upper surface 28*c* gradually rises in the rear-to-front direction, i.e. an upward projecting amount of the upper surface 28*c* from the base member's upper surface 25*c* gradually increases in the rear-to-front direction. Further, the pedestal section 28 has a threaded through-hole (hereinafter also referred to as "threaded hole") 28*f* extending axially from the upper surface 28*c* to the lower surface 28. Further, the base member 25 has a through-hole 25*f* formed in a position thereof positionally corresponding to the threaded hole 28*f*, and the through-hole 25*f* of the base member 25 has a greater diameter than the threaded hole 28*f*. The axis of the threaded hole 28*f* extends in an up-down direction and is inclined in the front-rear direction of the base member 25, and the upper surface 28*c* of the pedestal section 28 and the axis of the threaded hole 28*f* perpendicularly intersect each other. Further, a spring (coil spring) 12 is disposed around the outer periphery of the shaft section 11*b* of the spike member 11, and the shaft section 11*b* is threadedly engaged in the threaded hole 28*f* with the spring 12 sandwiched between the head section 11*a* and the upper surface 28*c* of the pedestal section 28.

Figure 6A:
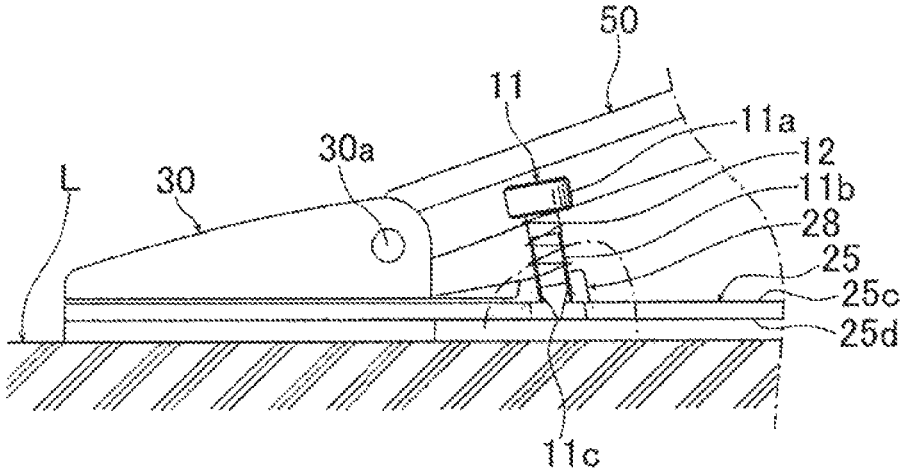
FIGS. 6A and 6B are views explanatory of an operational sequence for adjusting a projected amount of the spike member.
Figure 6B:
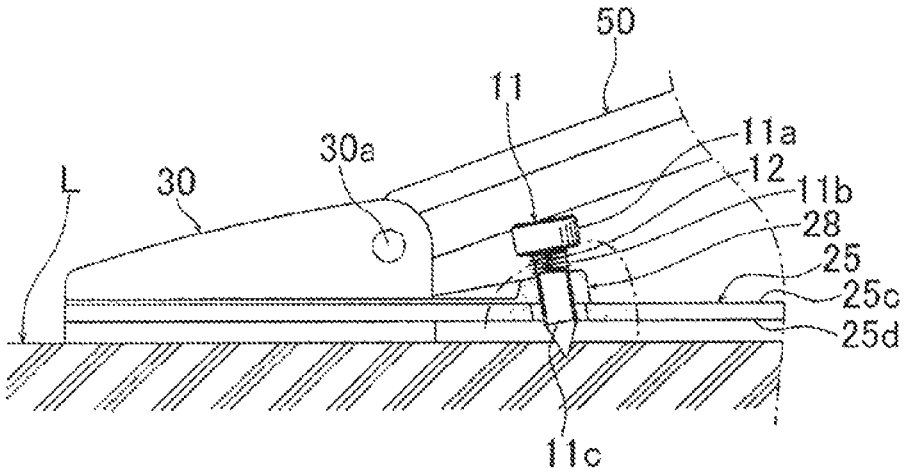

FIGS. 6A and 6B are views explanatory of an operational sequence for adjusting the projected amount of the spike member 11. The distal end portion 11*c* of the shaft section 11*b* can be projected out of the through-hole 25*f* downward beyond the lower surface 25*d* of the base member 25 and retracted back into the through-hole 25*f*, by the head section 11*a* being rotated to axially move the shaft section 11*b* downward and upward relative to the threaded hole 28*f*. Thus, when the foot pedal apparatus 1 is to be transported or carried from one place to another, the head section 11*a* is rotated in a thread loosening direction until the distal end portion 11*c* of the spike member 11 is retracted to within the through-hole 25*f* as shown in FIG. 6A. In this way, the tapered and sharpened distal end portion 11*c* is prevented from obstructing the carriage of the foot pedal apparatus 1 because the distal end portion 11*c* of the shaft section 11*b* is not projecting out of the through-hole 25*f* beyond the lower surface 25*d* of the base member 25. When the foot pedal apparatus 1 is to be installed on an installation site, the head section 11*a* is rotated in a thread tightening direction, with the foot pedal apparatus 1 placed on the floor surface of the installation site, to thereby move the spike member 11 axially downward against the biasing force of the spring 12 as shown in FIG. 6B. In this way, the distal end portion 11*c* of the spike member 11 can be projected downward beyond the lower surface 25*d* of the base member 25. Thus, the foot pedal apparatus 1 can be positioned (fixed) relative to the floor surface L by the thus-projected distal end portion 11*c* of the spike member 11 biting into a carpet or the like laid on the floor surface L.

Further, as shown in FIG. 4, the left and right spike members 11 are disposed at positions corresponding to opposite inwardly-recessed portions 51 of the foot board 50 that constitute a narrowed portion of the foot board 50. In other words, the foot board 50 has such a narrowed portion as to avoid contact with the left and right spike members 11 as viewed from above the upper surface 50*c* of the foot board 50. In other words, the spike members 11 are disposed at positions where they do not positionally overlap the foot board 50, and each of the spike members 11 is constructed in such a manner that its projected amount is adjustable by an operation performed from above the upper surface 50*c* of the foot board 50.

With the spike members 11 provided on the base member 25 in such a manner as to be capable of being projected downward beyond the base member's lower surface 25*d*, the first embodiment of the foot pedal apparatus 1 can effectively prevent positional displacement, relative to the installing surface, of the apparatus 1 from occurring due to depression of the foot board 50 during a drum performance. Particularly, because the spike members 11 are provided on the base member 25 rather than on the frame section 10, the spike members 11 can effectively achieve the effect of retaining the foot pedal apparatus 1 on the installing surface against lateral rotational force occurring due to human player's depression of the foot board 50. Further, because the spike members 11 are provided on the rear end proportion 25*b* of the base member 25 near the heel member 30, the spike members 11 can effectively prevent the heel member 30 from being displaced in a lateral (clockwise and counterclockwise) rotational direction about the front end portion 50*a* of the foot board 50.

Further, in the first embodiment of the foot pedal apparatus 1, the foot board 50 has such a narrowed portion as to avoid contact with the left and right spike members 11 as viewed from above the upper surface 50*c* of the foot board 50. Namely, the spike members 11 are disposed at positions avoiding a region immediately under the foot board 50, and each of the spike members 11 is constructed in such a manner that its projected amount is adjustable by an operation performed from above the upper surface 50*c* of the foot board 50. In this way, the human player of the drum can easily adjust the projected amount of the spike members 11 not only before but also during a drum performance. As a consequence, the human player can easily and reliably perform operations for preventing positional displacement of the foot pedal apparatus 1 not only before but also during a drum performance. What is more, it is possible to reliably prevent the foot board 5, descending in response to a human player's depressing operation, from interfering with the spike members 11 and hence significantly enhance the operability of the foot pedal apparatus 1.

Second Embodiment

Next, a second embodiment of the present invention will be described. Note that, in the following description of the second embodiment and corresponding figures in the drawings, the same or like elements as in the first embodiment are represented by the same reference numerals as in the first embodiment and will not be described here to avoid unnecessary duplication. Also note that other elements and features than those to be described below are the same as in the first embodiment.

Figure 7:
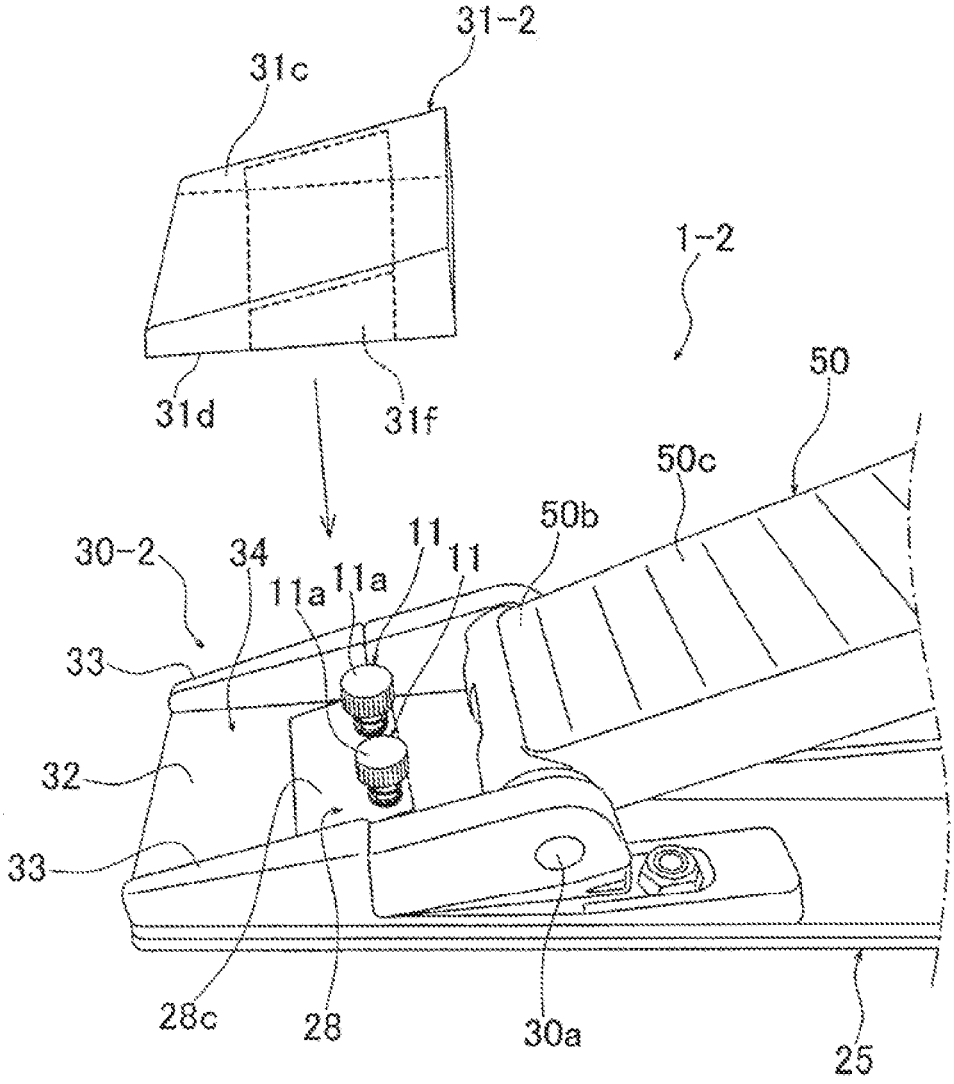
FIG. 7 is a fragmentary enlarged perspective view particularly showing a heel member in a drum foot pedal apparatus according to a second embodiment of the present invention.
Figure 8:
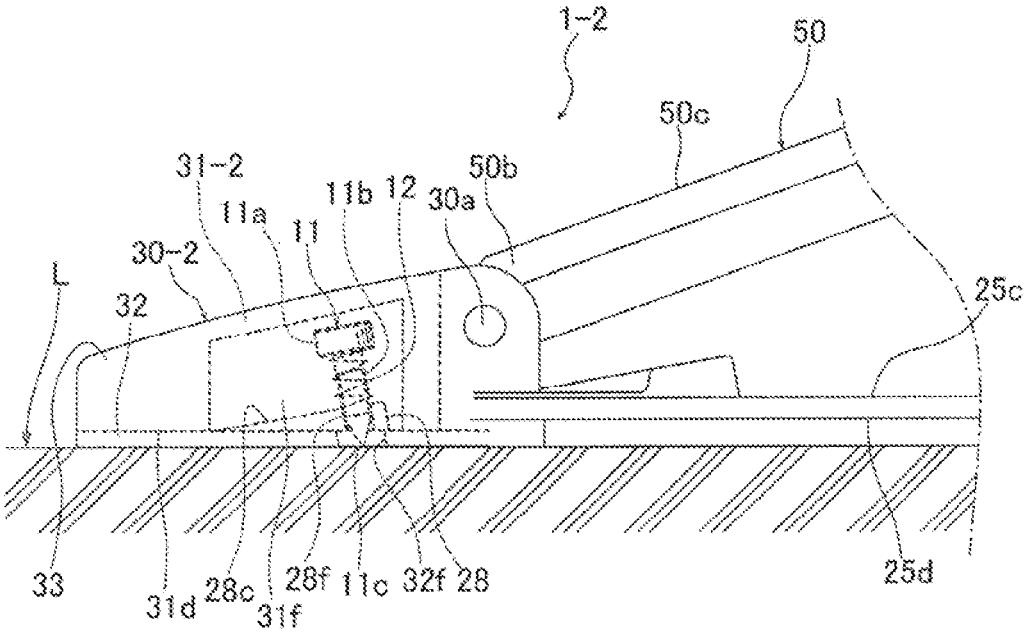
FIG. 8 is a side view of the heel member in the second embodiment of the foot pedal apparatus.

FIG. 7 is a fragmentary enlarged perspective view particularly showing a heel member 30-2 in a drum foot pedal apparatus 1-2 according to a second embodiment of the present invention, and FIG. 8 is a side view of the heel member 30-2. Note that FIG. 7 shows a cover member 31-2 as detached from the recessed portion 34 of the heel member 30-2.

Whereas the spike members 11 are provided on the base member 25 in the first embodiment of the foot pedal apparatus 1, the spike members 11 are provided on the heel member 30-2 in the second embodiment of the foot pedal apparatus 1-2. Namely, the left and right spike members 11 are provided side by side on two widthwise-spaced positions of the bottom wall 32 of the recessed portion 34 of the heel member 30-2. More specifically, the second embodiment includes a single pedestal section 28 having the slanting upper surface 28*c*. Each of the spike members 11 is threadedly engaged in the corresponding threaded hole 28*f* formed in the pedestal section 28 in such a manner that the distal end portion 11*c* is projectable through a through-hole 32*f* of the bottom wall 32 downward beyond the lower surface of the heel member 30-2.

Further, the cover member 31-2 put on and attached to the recessed portion 34 of the heel member 30-2 has an accommodating portion 31*f* formed in the underside 31*d* thereof for accommodating the head section 11*a* of each of the spike members 11. The accommodating portion 31*f* is in the form of a box-shaped recess opening downward in the underside 31*d*. Thus, with the cover member 31-2 attached to the recessed portion 34, the head section 11*a* of each of the spike members 11 is accommodated in the accommodating portion 31*f* of the cover member 31-2.

In a normal usage state of the second embodiment of the foot pedal apparatus 1-2, e.g. during a drum performance, the spike members 11 are kept accommodated in the accommodating portion 31*f* of the cover member 31-2. Thus, the spike members 11 would not become an obstacle during carriage, performance, etc. Further, when the foot pedal apparatus 1-2 is to be fixed on the installing surface L by projecting the spike members 11 downward, the head sections 11*a* of the spike members 11 can be readily exposed by merely detaching the cover member 31-2 from the heel member 30-2, so that the projected amount of each of the spike members 11 can be adjusted manually. Thus, it is possible to achieve both enhanced convenience at the time of carriage of the foot pedal apparatus 1-2 and during a drum performance and speedup of the installing operation of the foot pedal apparatus 1-2.

Further, with the accommodating portion 31*f* formed in the underside 31*d* of the cover member 31-2 for accommodating the head sections 11*a* of the spike members 11, the spike members 11 can be reliably accommodated in the underside of the cover member 31-2 by merely attaching the cover member 31-2 to the heel member 30-2 after putting the cover member 31-2 on the heel member 30-2.

Although not particularly shown in the drawings, a through-hole of such an appropriate size that would not become an obstacle during a drum performance may be formed in an upper wall portion of the cover member 31-2 so as to allow the human operator or player to rotate the head sections of the spike members 11 through such a through-hole. By the provision of such a through-hole, the human operator or player can promptly adjust the projected amount of each of the spike members 11 without detaching the cover member 31-2, which can achieve an even further enhanced efficiency of the installing operation of the foot pedal apparatus 1-2.

It should be appreciated that the present invention is not limited to the above-described embodiments and may be modified variously within the scope of the technical idea disclosed in the claims, specification and drawings. For example, whereas the first embodiment of the present invention has been described above in relation to the case where the spike members 11 are provided on the rear end portion 25*b* of the base member 25, the spike members 11 may be provided on any other suitable positions of the base member 25. Further, the number of the spike members in the present invention is not limited to just two and may be any other desired number, and the specific shape of the spike members is not limited to that described in relation to the above-described embodiments, and the spike members may be of any other desired shapes.

Moreover, whereas the embodiments of the drum foot pedal apparatus have each been described as a drum foot pedal for striking a bass drum of an acoustic drum, the drum foot pedal apparatus of the present invention may be applied as a drum foot pedal for striking a bass drum pad of an electronic drum.

This application is based on, and claims priority to, JP PA 2015-194503 filed on 30 Sep. 2015. The disclosure of the priority application, in its entirety, including the drawings, claims, and the specification thereof, are incorporated herein by reference.

What is claimed is:

1. A drum foot pedal apparatus comprising:

a heel member;

a cover member that detachably covers the heel member;

a foot board pivotably supported at one end portion of the heel member;

a beater configured to strike a drum head in response to a depressing operation of the foot board;

a frame section having a strut member pivotably supporting the beater;

a base member, with one end thereof fixed to the frame section and another end thereof fixed to the heel member, interconnecting the frame section and the heel member; and a spike member disposed underneath the cover member and on the heel member, and projectable downward beyond a lower surface of the heel member, wherein the spike member is disposed not positionally overlapping the foot board, and wherein a projected amount of the spike member is configured to be adjustable by an operation from above an upper surface of the foot board.

2. The drum foot pedal apparatus as claimed in claim 1, wherein the cover member has an accommodating portion in an underside thereof for accommodating a head section of the spike member.

3. A drum foot pedal apparatus comprising:

a heel member;

a foot board pivotably supported at one end portion of the heel member;

a beater configured to strike a drum head in response to a depressing operation of the foot board;

a frame section having a strut member pivotably supporting the beater;

a base member, with one end thereof fixed to the frame section and another end thereof to the heel member, interconnecting the frame section and the heel member; and a spike member disposed on the base member and projectable downward beyond a lower surface of the base member, wherein the foot board has a narrowed portion, wherein the spike member is disposed on the base member laterally of the narrowed portion, wherein the narrowed portion of the foot board is configured to avoid contact with the spike member and not positionally overlap the spike member, and wherein a projected amount of the spike member is configured to be adjustable by an operation from above an upper surface of the foot board.

* * * * *